US007743638B2

(12) United States Patent
Lindner et al.

(10) Patent No.: US 7,743,638 B2
(45) Date of Patent: Jun. 29, 2010

(54) ADJUSTING CYLINDERS IN ROLLING STANDS, INCLUDING VERTICAL EDGING STANDS

(75) Inventors: Florian Lindner, Netphen (DE); Stefan Wendt, Hilchenbach (DE)

(73) Assignee: SMS Siemag Aktiengesellschaft, Düsseldorf (DE)

( * ) Notice: Subject to any disclaimer, the term of this patent is extended or adjusted under 35 U.S.C. 154(b) by 0 days.

(21) Appl. No.: 12/321,182

(22) Filed: Jan. 17, 2009

(65) Prior Publication Data

US 2009/0193867 A1 Aug. 6, 2009

Related U.S. Application Data

(62) Division of application No. 10/580,168, filed as application No. PCT/EP2004/011815 on Oct. 19, 2004, now Pat. No. 7,631,531.

(30) Foreign Application Priority Data

Nov. 19, 2003 (DE) ..... 103 54 235
Aug. 14, 2004 (DE) ..... 10 2004 039 494

(51) Int. Cl.
*B21J 9/18* (2006.01)

(52) U.S. Cl. ..... 72/453.01; 72/453.05; 72/245

(58) Field of Classification Search ..... 72/199, 72/252.5, 237, 244, 245, 453.01, 453.02, 72/453.18, 248, 453.05; 100/269.01–269.21
See application file for complete search history.

(56) References Cited

U.S. PATENT DOCUMENTS 5,142,892 A * 9/1992 Noe et al. ..... 72/19.9

* cited by examiner

*Primary Examiner*—Dana Ross
*Assistant Examiner*—Stephanie Jennings
(74) *Attorney, Agent, or Firm*—Friedrich Kueffner

(57) ABSTRACT

An adjusting cylinder for long, rapid lifting movements in rolling stands, including vertical edging stands, wherein each adjusting cylinder has at least one piston which acts through the bearing chocks of at least one work roll or of an interposed roll to adjust a work roll on both sides, wherein each adjusting cylinder has a piston that is equipped with two oppositely directed piston rods, and each piston is inserted in a recess in the cylinder base or cylinder cover, such that the base and cover have coaxially arranged bores through which the piston rods pass. The surface formed by the piston and the piston rod is smaller than the surface formed by the piston and the piston rod.

1 Claim, 7 Drawing Sheets

ADJUSTING CYLINDERS IN ROLLING STANDS, INCLUDING VERTICAL EDGING STANDS

CROSS-REFERENCE TO RELATED APPLICATIONS

The present application is a Divisional Application of U.S. Patent application Ser. No. 10/580,168 filed May 19, 2006, now U.S. Pat. No. 7,631,531.

The invention concerns adjusting cylinders for long, rapid lifting movements in rolling stands, including vertical edging stands, wherein each cylinder has at least one piston, which acts by means of the bearing chocks of at least one work roll or of an interposed roll to adjust a work roll on both sides.

The purpose of the adjusting device in vertical edging stands as well as in horizontal stands is to adjust, to maintain, and, when necessary, to control automatically the necessary roll gap.

In vertical edging stands, adjusting devices are purely mechanical or purely hydraulic, or they involve a combination of mechanical and hydraulic adjustment. The arrangement of one or two adjustment devices per side is technically possible and practical.

For example, a purely hydraulic adjusting device in vertical edging stands in the roughing stand edger of a hot-strip rolling mill is known. This adjusting device is realized as a conventional differential cylinder that consists of a piston, a cylinder cover, and a cylinder base.

However, this design has limits both in the necessary oil requirement and thus the travel rate and in the radial stress sensitivity with the piston rod fully extended.

The well-known problems have made it apparent that purely hydraulic adjustment in vertical edging stands for plate-rolling mills so far is difficult to master, for it is important to make a very long lift at very high speed, because after the turning of a plate, it is necessary to move within a short amount of time from minimum roll gap to maximum roll gap.

One prior art document describes a positioning control device for vertical edging stands for width adjustment of the rolled material by means of an electric screw spindle adjusting device, combined with hydraulic servo valve-controlled cylinder devices for adjustments against the rolling load. The cylinders are arranged at the side of the crossheads of the uprights of the vertical stands and are connected by a coupling plate with the adjusting nuts of the screw spindle adjusting device.

The document DE-OS 32 12 525 A1 describes an electro-hydraulic roll gap controlling and adjusting device, especially for the rolls of a vertical stand, which consists of an adjusting cylinder, whose adjusting piston can move in a cylinder bore by the action of pressure changes in a pressure medium, and of a plunger, which is immersed in the pressure medium and whose motions which are controlled by a hydraulic lifting device produce the movements of the adjusting cylinder, wherein the hydraulic lifting device is controlled by a servo valve, a scanner for detecting the rolling forces by pressure measurement, and a measuring device for determining the actual position of the plunger, and of a comparator that processes the desired/actual position of the plunger to obtain a change signal. The adjusting spindle is designed as a hollow body with an axial passage with different diameter segments, such that the passage of the adjusting spindle houses the hydraulic piston-cylinder units for controlling the width and/or thickness.

The document U.S. Pat. No. 4,658,622 A describes an edger mill with a pair of oppositely mounted vertical rolls.

Each roll is provided with a drive comprising two drive sections extending generally parallel. The first drive section has a splined portion coupled to a drive pinion for accommodating large adjustments effected in the roll gap when the mill is not under load. The second drive section is connected to the first drive section by a splined coupling which accommodates small roll gap adjustments effected when the mill is under load.

The document EP 0 493 430 B1 describes an edger mill with a pair of movable vertical housings, with means for displacing each movable housing horizontally towards and away from the other housing, and with a pair of rolls whose longitudinal axes are arranged vertically. The rolls are rotatably supported in corresponding cassettes. The cassettes are supported by correspondingly movable housings in such a way that they are moved with them and are located inside the housing. In addition, means are provided for displacing each cassette vertically relative to its associated movable housing.

The document EP 0 491 785 B1 describes a vertical rolling mill with two vertically movable housings and with two rolls, which are rotatably mounted in associated cassettes and whose longitudinal axes are vertically arranged, wherein the cassettes are supported by movable housings and are located inside the housings. A device is provided for moving each movable housing and its associated cassette horizontally towards and away from the other housing, and a device is provided for moving each cassette relative to its housing horizontally towards and away from the other cassette. Each housing has a drive mechanism, whose output side has a drive connection with the lower end of the roll in the associated cassette, and whose input side has a drive connection with a horizontal drive shaft. Each drive mechanism has a universal joint which permits drive power to be transmitted from the shaft to the roll, even when the cassette is horizontally displaced a certain amount relative to its housing.

The document DE-OS 2 047 240 describes a method for rolling in a vertical stand, wherein the roll gap is automatically controlled during the rolling. A slab is first edge rolled along its side edges in a vertical stand and then flat rolled in a horizontal stand. The roll gap of the vertical stand is automatically varied during the rolling of the end sections of the slab in such a way that the dimensions of the end sections during the subsequent flat rolling do not deviate significantly from the dimensions of the remaining middle section of the slab.

The document EP 0 868 946 A2 discloses an edging stand arranged downstream of a continuous casting installation and upstream of a finishing train. The edging stand is intended to be controlled in such a way that the prestrip can reliably enter the first stand of the finishing train, such that, to avoid cracks in the strip edge region, a microstructural transformation in the strip edge region is to be ensured. To this end, it is proposed that pressure control loops for monitoring the degree of edging and for overload limitation and differential load monitoring are superimposed on the position control loops for the edging stand.

The document EP 0 450 294 B1 discloses an adjusting device for setting the roll gap in rolling stands, especially in strip rolling stands for hot or cold rolling, with at least two hydraulic adjusting cylinders, which act on both sides of a given work roll to be adjusted via chocks and possibly an interposed backup roll. Each adjusting cylinder has a cup-shaped piston, which is guided in a cylinder housing on a cylinder shaft and in a cylinder collar. A central piston surface formed in the inner bottom of the cup-shaped piston and an annular piston surface formed by the rim of the cup-shaped piston can be acted upon independently of each other, either individually or jointly, by pressure medium.

Proceeding from the above prior art, the objective of the invention is to improve the previously known purely hydraulic adjusting devices, such that the number of adjusting cylinders is not to be fixed, so that even the arrangement of only one cylinder per side should also remain technically possible.

In accordance with the invention, in the case of adjusting cylinders of the type specified in the introductory clause of Claim 1, this objective is achieved by providing the adjusting cylinder with a second piston rod in such a way that each adjusting cylinder has a piston that is equipped with two oppositely directed piston rods, and each piston is inserted in a recess in the cylinder base or cylinder cover, wherein said base and cover have coaxially arranged bores through which the piston rods pass.

The design of the adjusting cylinder in accordance with the invention focuses on an equal support length over the entire cylinder stroke length, such that the cross-sectional area of the second piston rod considerably reduces the oil requirement, so that a higher travel speed is realized at the same pumping capacity. The application of the invention is thus not limited to a vertical edging stand in plate-rolling mills, but rather the invention can also be advantageously used in other types of stands in other types of installations. A far-reaching advantage of this invention allows optimization of oil requirement and travel speed.

Additional features of the invention are specified in the dependent claims.

The proposed casing of the second piston rod is designed as an additional cylinder oil chamber. During the travel motion towards the rolling stock, when no rolling force is being applied, a short circuit is produced between the draining oil chamber and the additional, filling oil chamber of the cylinder by suitable control means. This reduces the increased pump output. During rolling, a short circuit can be produced between the two oil chambers on the side of the additional rod. This makes it possible to apply the necessary rolling force with the complete piston surface.

The invention is described below with reference to the drawings, some of which are schematic.

FIG. 1 shows a schematic drawing of the adjusting cylinder with piston, piston rod, seals, and the like.

Figure 1:
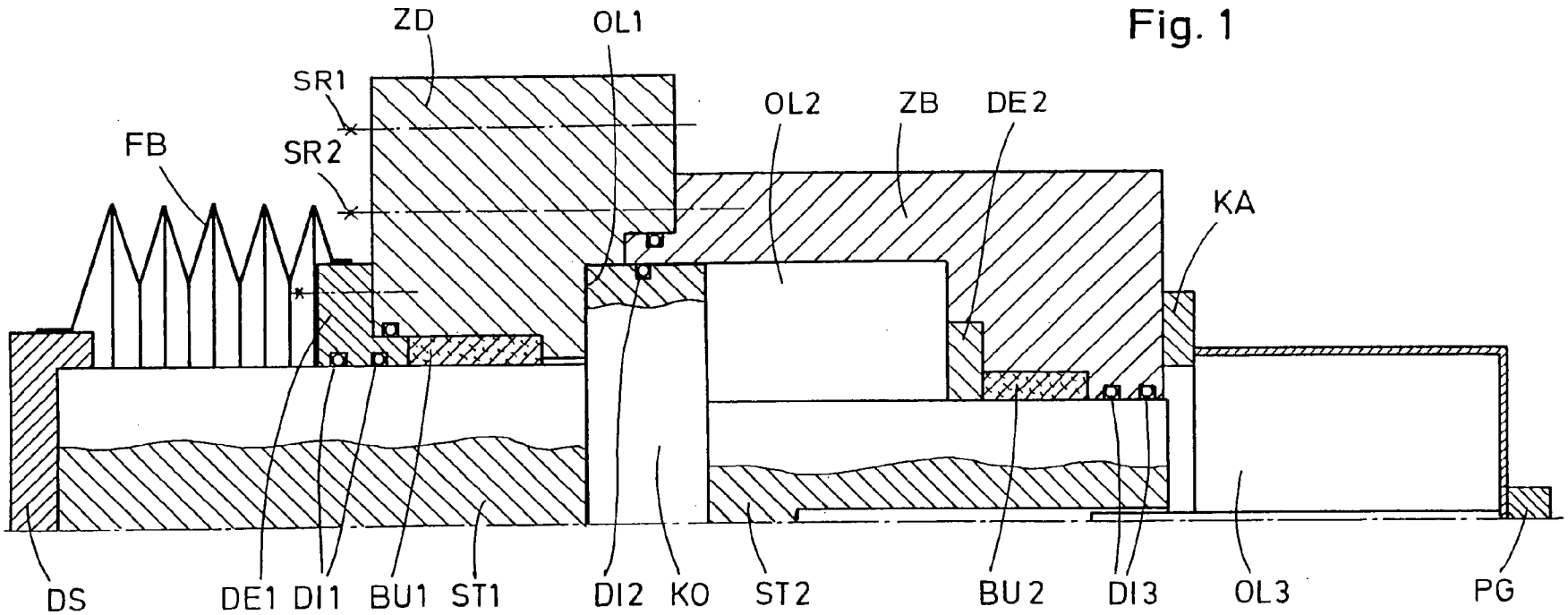

As FIG. 1 shows, the adjusting cylinder consists of a piston (KO) with a piston rod (ST1) and a piston rod (ST2). The piston is inserted in the cylinder cover (ZD) and the cylinder base (ZB), both of which have coaxially arranged bores through which the piston rods pass. Holding fixtures for piston guide elements, which are realized here as metal bushings (BU1, BU2), are present in both of these bores. Both metal bushings (BU1, BU2) are held by corresponding covers (DE1, DE2). The seals (DI1 to DI3) that belong to the cylinder are located in the cover (DE1), in the piston (KO), and in the cylinder base (ZB). The cylinder base (ZB) and cylinder cover (ZD) are screwed together with screws (SR2). The complete adjusting cylinder is screwed on the upright of the rolling stand with screws (SR1) A thrust member (DS) is present as an extension of the rod (ST1). The rod (ST1) is protected by a convoluted bellows (FB). The convoluted bellows (FB) is either supported on the rod (ST1) by sliding disks or is held on guide rods (not shown here) by means of runners.

The cylinder piston has an antitorsion device, which is either realized as a frame connection (not shown here) between the thrust members (DS) of two adjusting cylinders arranged one above the other or consists of extensions of the thrust member (DS), which are supported in the aforementioned guide rods. A casing (KA) is present as an extension of the cylinder base (ZB). On the one hand, this casing (KA) protects the rod (ST2) and, on the other hand, it can be optionally used as an additional oil chamber (OL3). A position measuring system is present as an extension of the casing (KA) (realized here as a position sensor (PG)), which detects the position of the cylinder piston.

Figure 4:
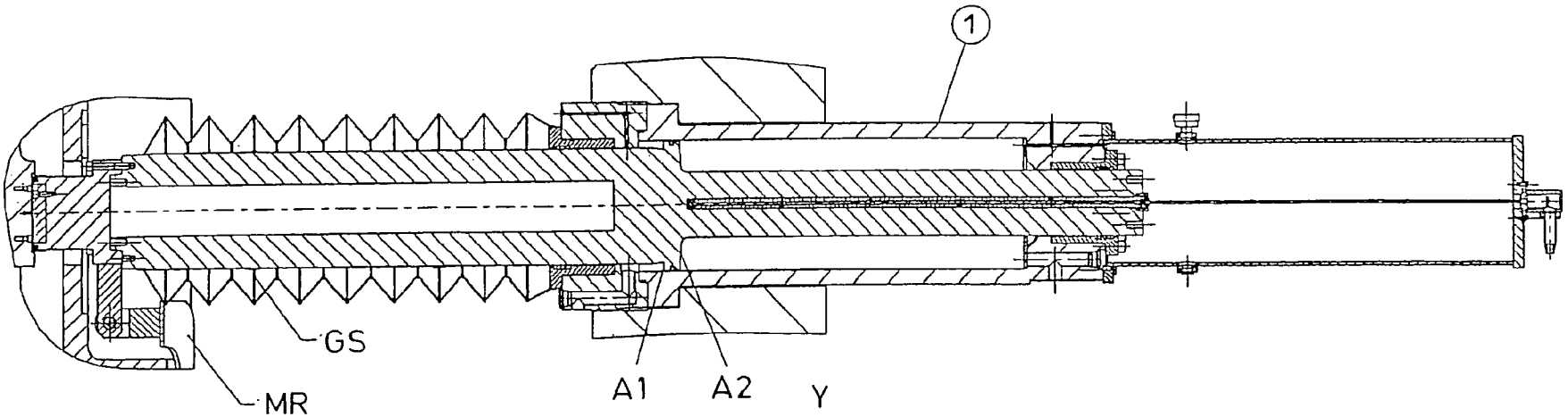
FIG. 4 shows an adjusting cylinder with two pressure spaces.
Figure 5:
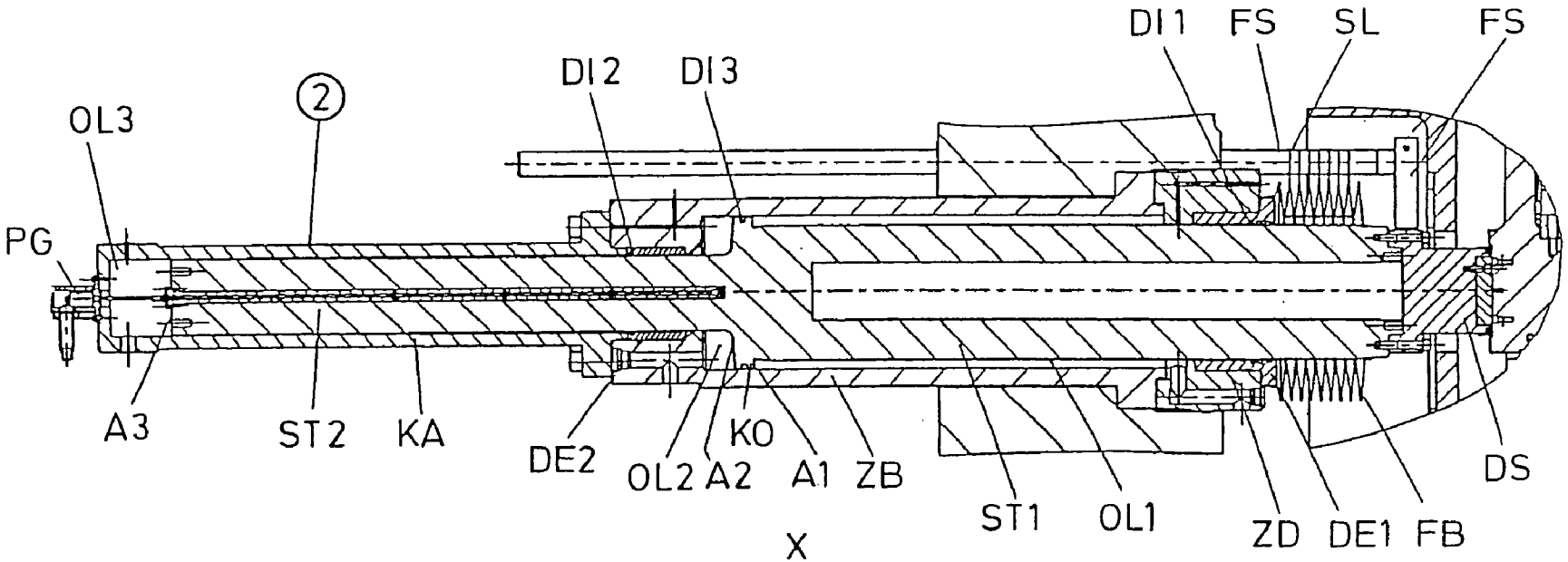
FIG. 5 shows an adjusting cylinder with three pressure spaces.

The design of the adjusting cylinder in FIG. 4 and FIG. 5 is analogous. In the embodiment as a plunger cylinder (FIGS. 6 and 7), the cylinder cover and cylinder base are one part (PB), and the piston (KO) now consists only of the adjusting cylinder rods (ST3, ST4).

The oil chambers (OL1, OL2, OL3) shown in FIG. 5 form, depending on the design, the force-relevant annular surfaces A1 and A2 or the circular surface A3.

Figure 2:
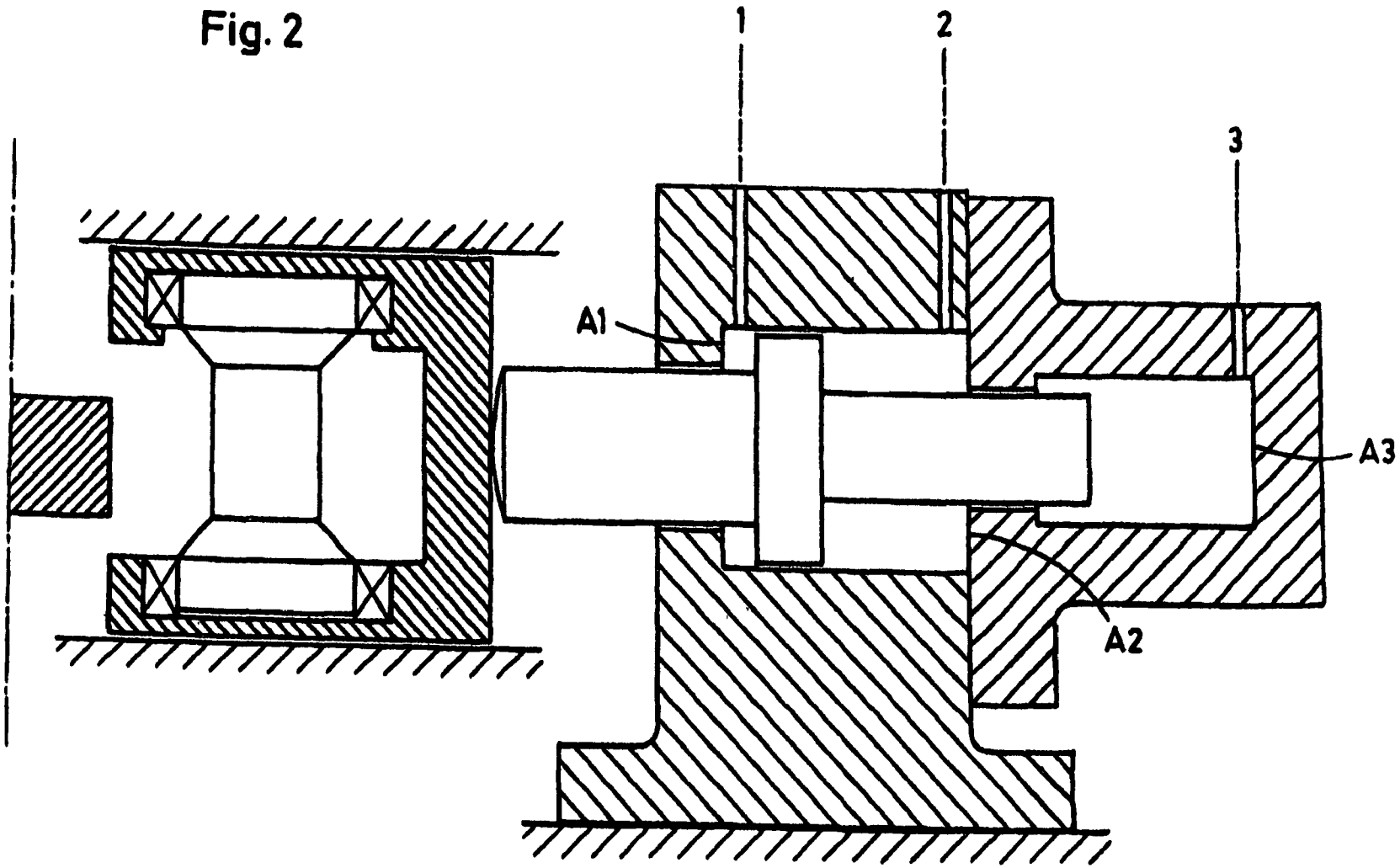
FIG. 2 shows a schematic drawing of the control system of the adjusting cylinder for rapid advance, edging, and rapid return.

FIG. 2 schematically illustrates the control system for rapid advance and return of the adjusting cylinder with low volume flow or edging of the rolling stock with great force. The individual operating phases 1 to 3, i.e., rapid advance, edging with great force, and rapid return, are readily apparent from FIG. 2.

Phase 1: rapid advance with reduced force:

pressure on surface A2; as little pressure as possible is applied to surfaces A1 and A3 ($p_2 \gg 0$; $p_1 \approx 0$)

optimum: A1≈A3; lines 1 and 3 can be connected, oil then flows from line 1 to line 3 or analogous exchange of surfaces A2 and A3

Phase 2: edging with great force pressure on surface A2 and surface A3; surface A1<surfaces A2+A3

Phase 3: rapid return pressure on surface A1; no pressure or very little pressure is applied to surfaces A2 and A3

Figure 3:
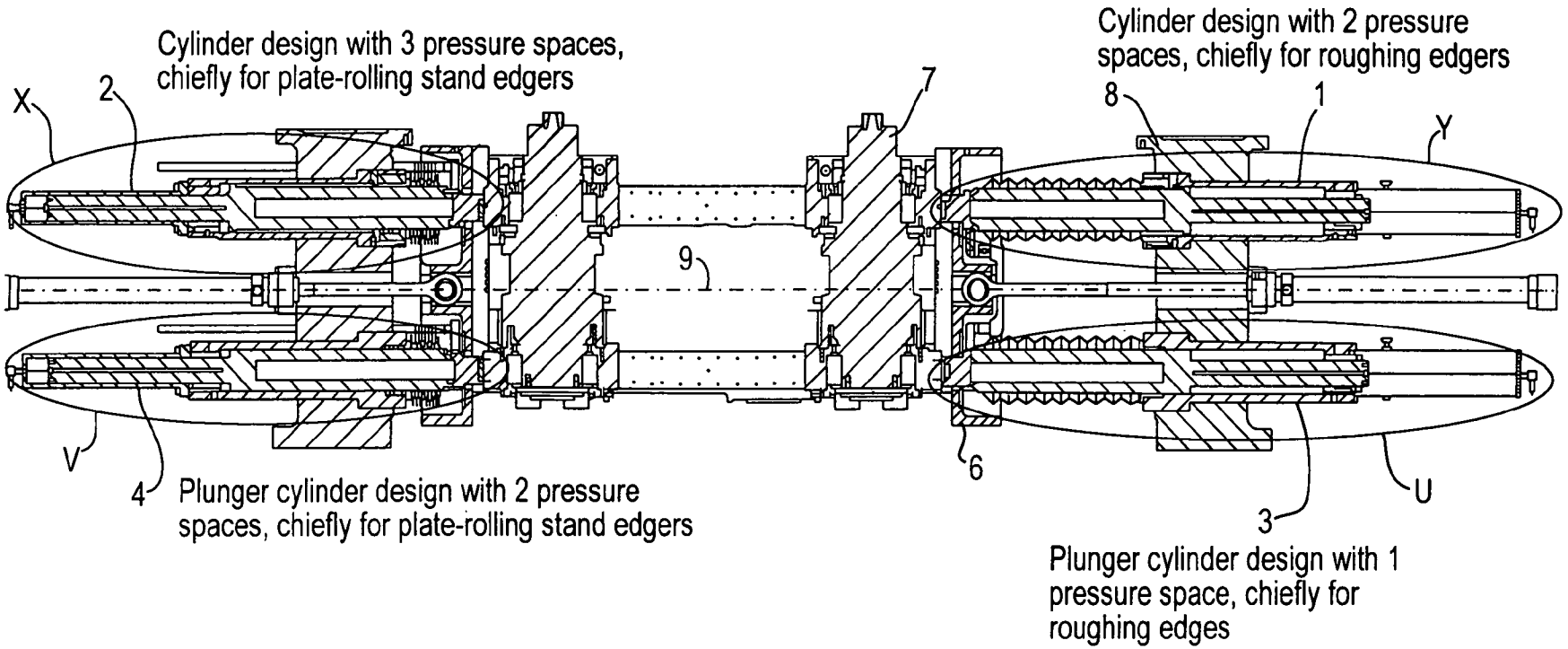
FIG. 3 shows the adjusting cylinders in the mounted state, e.g., in an edging stand.

FIG. 3 shows four different designs of adjusting cylinders in their mounted state in an edging stand. All four designs have the common feature of two piston rods. For use of the adjusting cylinder in an edging stand, four designs of the adjusting cylinder are shown in FIG. 3: on each side, two adjusting cylinders arranged above and below the center plane (9) of the upright. However, the arrangement of only one adjusting cylinder per side is also technically possible. The cylinders are housed in corresponding bores of the edger upright (8) and act on the edging rolls (7). In conjunction with a balance crosshead (6), the balance cylinder (5) squeezes the play out of the whole system. The balance cylinder (5) can also take on the function of a pull-back cylinder.

FIGS. 4 to 7 show the following cylinder embodiments:

FIG. 4 shows an adjusting cylinder with 2 pressure spaces and the effective surfaces A1 and A2.

FIG. 5 shows an adjusting cylinder with 3 pressure spaces and the effective surfaces A1, A2, and A3.

Figure 6:
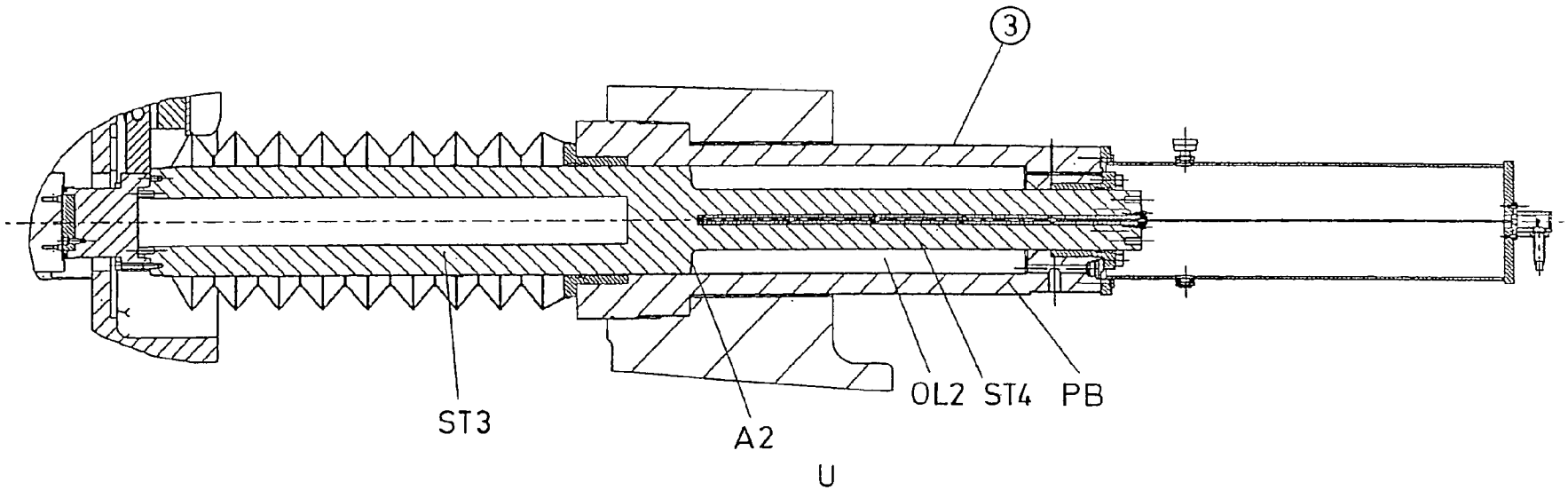
FIG. 6 shows a plunger cylinder with one pressure space.

FIG. 6 shows a plunger cylinder with 1 pressure space and the effective surface A2.

Figure 7:
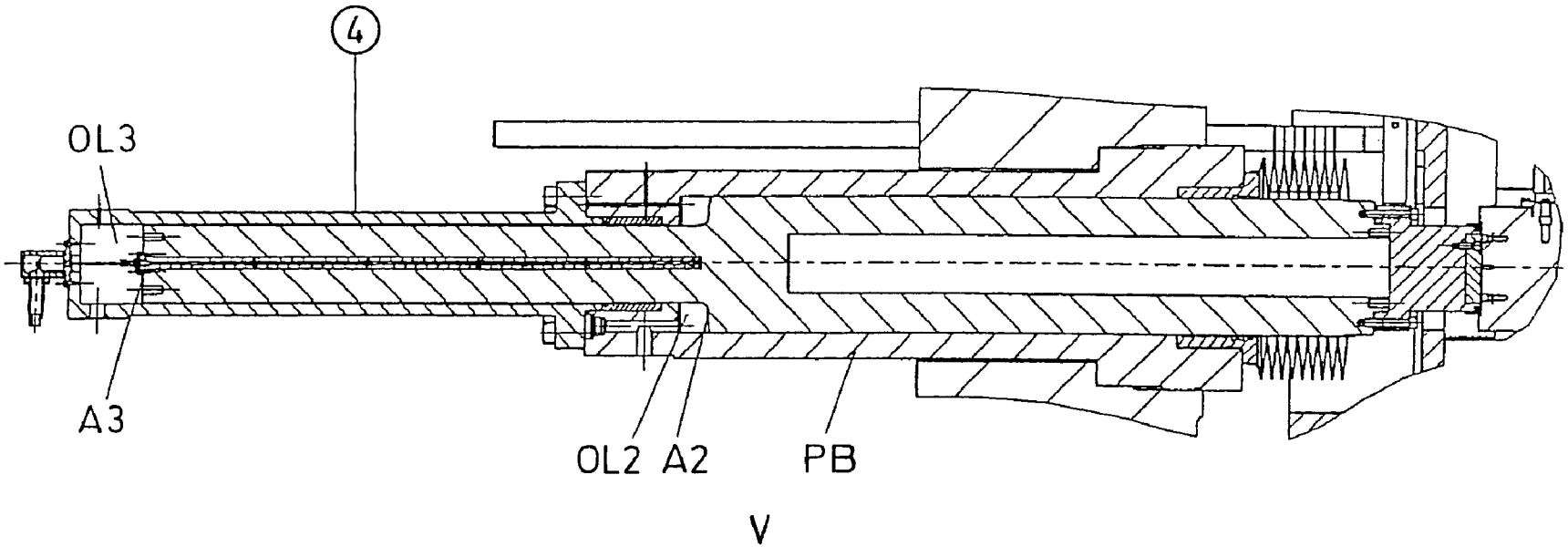
FIG. 7 shows a plunger cylinder with two pressure spaces.

FIG. 7 shows a plunger cylinder with 2 pressure spaces and the effective surfaces A2 and A3.

The operation of the individual types can be selected according to the necessary predetermined specifications, e.g., according to FIG. 4: double-acting cylinder with pressure application on the annular surface A2 for rapid advance and for application of the rolling force; pressure is applied to the annular surface A1 to return the cylinder FIG. 5: double acting cylinder with pressure application on the annular surface A2 and/or the circular surface A3 for rapid advance and use of the annular surface A2 and/or the circular surface A3 to apply the rolling force; pressure is applied to the annular surface A1 to return the cylinder FIG. 6: plunger cylinder with pressure application on the annular surface A2 for rapid advance and for application of the rolling force; the balance cylinder (5) acts as a pull-back cylinder FIG. 7: plunger cylinder with pressure application on the annular surface A2 and/or the circular surface A3 for rapid advance and use of annular surface A2 and/or circular surface A3 to apply the rolling force; the balance cylinder (5) acts as a pull-back cylinder or FIG. 5: single-acting cylinder with pressure application on the annular surface A2 and/or the circular surface A3 for rapid advance and use of the annular surface A2 and/or the circular surface A3 to apply the rolling force; no pressure is applied to the annular surface A1; the balance cylinder (5) acts as a pull-back cylinder or FIG. 4: single-acting cylinder with pressure application on the annular surface A2 for rapid advance and for application of the rolling force; no pressure is applied to the annular surface A1; the balance cylinder (5) acts as a pull-back cylinder.

Differential arrangements of the pressure spaces A1 and/or A2 and/or A3, e.g., for applying the necessary amounts of oil, are also conceivable. Pressure is applied to the individual pressure spaces by solenoid valves, servo valves, check valves, pumps, tanks, pressure tanks, reservoirs, etc., in accordance with the state of the art.

The invention claimed is:

1. Method for operating an adjusting cylinder, comprising a piston (KO), which is frictionally movable in a housing with at least two parts (G1, G2) that define a cylinder, the piston being movable between three pressure surfaces (A1, A2, A3) of the housing, and which acts on a chock (ES) of a rolling stand, the piston (KO) being equipped with two oppositely directed piston rods (ST1, ST2), the two housing parts having coaxially arranged bores through which the piston rods (ST1, ST2) pass, a first of the pressure surfaces (A1) being formed on one side of the piston (KO) by the first piston rod (ST1) and being smaller than an oppositely directed annular, second of the pressure surfaces (A2) formed on an opposite side of the piston (KO) by the second piston rod (ST2), a third of the pressure surfaces (A3) being formed so as to face a free end of the second piston rod (ST2), wherein, for rapid advance of the piston (KO), pressure is applied to the first surface (A1), while no pressure is applied to the second and third surfaces (A2) or (A3) and (A3) or (A2).

* * * * *